US007063503B2

(12) United States Patent
Meisels

(10) Patent No.: US 7,063,503 B2
(45) Date of Patent: Jun. 20, 2006

(54) TURBINE SHROUD COOLING SYSTEM

(75) Inventor: David Meisels, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 92 days.

(21) Appl. No.: 10/824,413

(22) Filed: Apr. 15, 2004

(65) Prior Publication Data

US 2005/0232752 A1 Oct. 20, 2005

(51) Int. Cl.
*F01D 25/14* (2006.01)

(52) U.S. Cl. ..... 415/116; 415/139

(58) Field of Classification Search ..... 415/116, 415/115, 173.1, 173.3, 139, 138, 135; 277/641, 277/642, 644
See application file for complete search history.

(56) References Cited

U.S. PATENT DOCUMENTS

| | | | | |
|---|---|---|---|---|
| 2,685,429 | A | | 8/1954 | Auyer |
| 2,863,634 | A | | 12/1958 | Chamberlin et al. |
| 2,962,256 | A | | 11/1960 | Bishop |
| 3,728,039 | A | | 4/1973 | Plemmons et al. |
| 4,013,376 | A | | 3/1977 | Bisson et al. |
| 4,303,371 | A | | 12/1981 | Eckert |
| 4,526,226 | A | | 7/1985 | Hsia et al. |
| 4,573,865 | A | | 3/1986 | Hsia et al. |
| 5,165,847 | A | | 11/1992 | Proctor et al. |
| 5,169,287 | A | | 12/1992 | Proctor et al. |
| 5,480,281 | A | * | 1/1996 | Correia ..... 415/115 |
| 5,538,393 | A | | 7/1996 | Thompson et al. |
| 5,584,651 | A | | 12/1996 | Pietraszkiewicz et al. |
| 5,868,398 | A | * | 2/1999 | Maier et al. ..... 277/643 |
| 5,993,150 | A | | 11/1999 | Liotta et al. |
| 6,126,389 | A | | 10/2000 | Burdgick |
| 6,139,257 | A | | 10/2000 | Proctor et al. |
| 6,146,091 | A | * | 11/2000 | Watanabe et al. ..... 415/115 |
| 6,196,792 | B1 | | 3/2001 | Lee et al. |
| 6,231,303 | B1 | | 5/2001 | Tiemann et al. |
| 6,390,769 | B1 | * | 5/2002 | Burdgick et al. ..... 415/116 |
| 6,431,825 | B1 | * | 8/2002 | McLean ..... 415/135 |
| 6,612,806 | B1 | | 9/2003 | Bolms et al. |
| 6,779,597 | B1 | | 8/2004 | DeMarche et al. |

* cited by examiner

*Primary Examiner*—Edward K. Look
*Assistant Examiner*—Nathan Wiehe
(74) *Attorney, Agent, or Firm*—Ogilvy Renault

(57) ABSTRACT

A cooled turbine shroud assembly includes a first cooling path and a second cooling path adapted to provide shroud impingement air at different pressures to enhance efficiency. The cooling air is preferably acquired from a common source of secondary air. In one aspect the assembly, a shroud support supports a shroud ring and the cooling paths are separated in part by a flexible seal.

25 Claims, 8 Drawing Sheets

TURBINE SHROUD COOLING SYSTEM

TECHNICAL FIELD

The present invention relates to gas turbine engines and, more particularly, to turbine shroud cooling.

BACKGROUND OF THE INVENTION

Being exposed to very hot gases, turbine shrouds usually needs to be cooled. However, since flowing coolant through the shroud diminishes overall engine performance, it is typically desirable to minimize the cooling flow consumption without degrading shroud segment durability. Heretofore, the proposed solutions still generally demand higher than required cooling consumption which therefore limits engine performance.

Accordingly, there is a need to provide an improved shroud cooling system which addresses these and other limitations of the prior art.

SUMMARY OF THE INVENTION

It is therefore an aim of the present invention to minimize the cooling flow consumption of a turbine shroud.

An aspect of the present invention therefore provides a gas turbine shroud assembly comprising a shroud body defining a first cooling path and a second cooling path, the first and second cooling paths communicating with a common cooling air supply, the first cooling path adapted to deliver cooling air to a first shroud surface and the second cooling path adapted to deliver cooling air to a second shroud surface, wherein the first and second paths are configured such that, in use, cooling air is delivered to said first and second shroud surfaces by said first and second cooling paths at different pressures relative to one another.

Another aspect of the present invention provides a turbine shroud assembly comprising a shroud support supporting a shroud ring, a cooling plenum defined between said shroud ring and said shroud support, and a seal extending from said shroud ring to said shroud support, the seal splitting a first portion of the cooling plenum from a second portion thereof and thereby permitting a pressure differential to be maintained between the first portion and the second portion.

Another aspect of the present invention provides a gas turbine engine comprising: a compressor section, a combustion section and a turbine section serially connected to one another, a shroud ring concentrically mounted within a shroud support for surrounding a stage of turbine blades, and a radially extending seal between the shroud support and the shroud ring, the seal allowing for thermal expansion and contraction of the shroud ring relative to the shroud support while separating an upstream plenum from adjacent downstream plenum and maintaining a pressure differential therebetween.

Another aspect of the present invention provides a seal for a gas turbine engine comprising a shroud support and a shroud member, the shroud support and shroud member co-operating to define a plurality of shroud impingement cooling paths therethrough, the shroud support including at least one circumferential groove through a central portion thereof between at least a first impingement cooling path and a second impingement cooling path, the shroud member including at least one circumferential groove through a central portion thereof between at least a first impingement cooling path and a second impingement cooling path, the seal comprising a first curved end adapted for sealing insertion into the shroud support circumferential groove, and a second curved end adapted for sealing insertion into the shroud member circumferential groove, the seal thereby adapted to maintain a pressure differential between said first and second impingement cooling paths.

Yet another aspect of the present invention provides a method of cooling a shroud ring surrounding a stage of turbine blades in a gas turbine engine, the method comprising the steps of: a) providing an upstream cooling path and a downstream cooling path through a shroud support holding the shroud ring, said upstream and downstream cooling paths leading to a shroud internal cavity, b) axially dividing said shroud internal cavity into an upstream plenum and a downstream plenum, said upstream and downstream plenums being respectively in fluid flow communication with said upstream and said downstream paths, c) flowing a volume of cooling fluid through said upstream and downstream cooling paths, and d) in at least one of said upstream and downstream cooling paths causing the pressure of the cooling fluid to drop to permit a pressure differential to subsist between the upstream plenum and the downstream plenum.

BRIEF DESCRIPTION OF THE DRAWINGS

Reference is now made to the accompanying Figures depicting aspects of the present invention, in which.

DETAILED DESCRIPTION OF THE PREFERRED EMBODIMENTS

Figure 1:
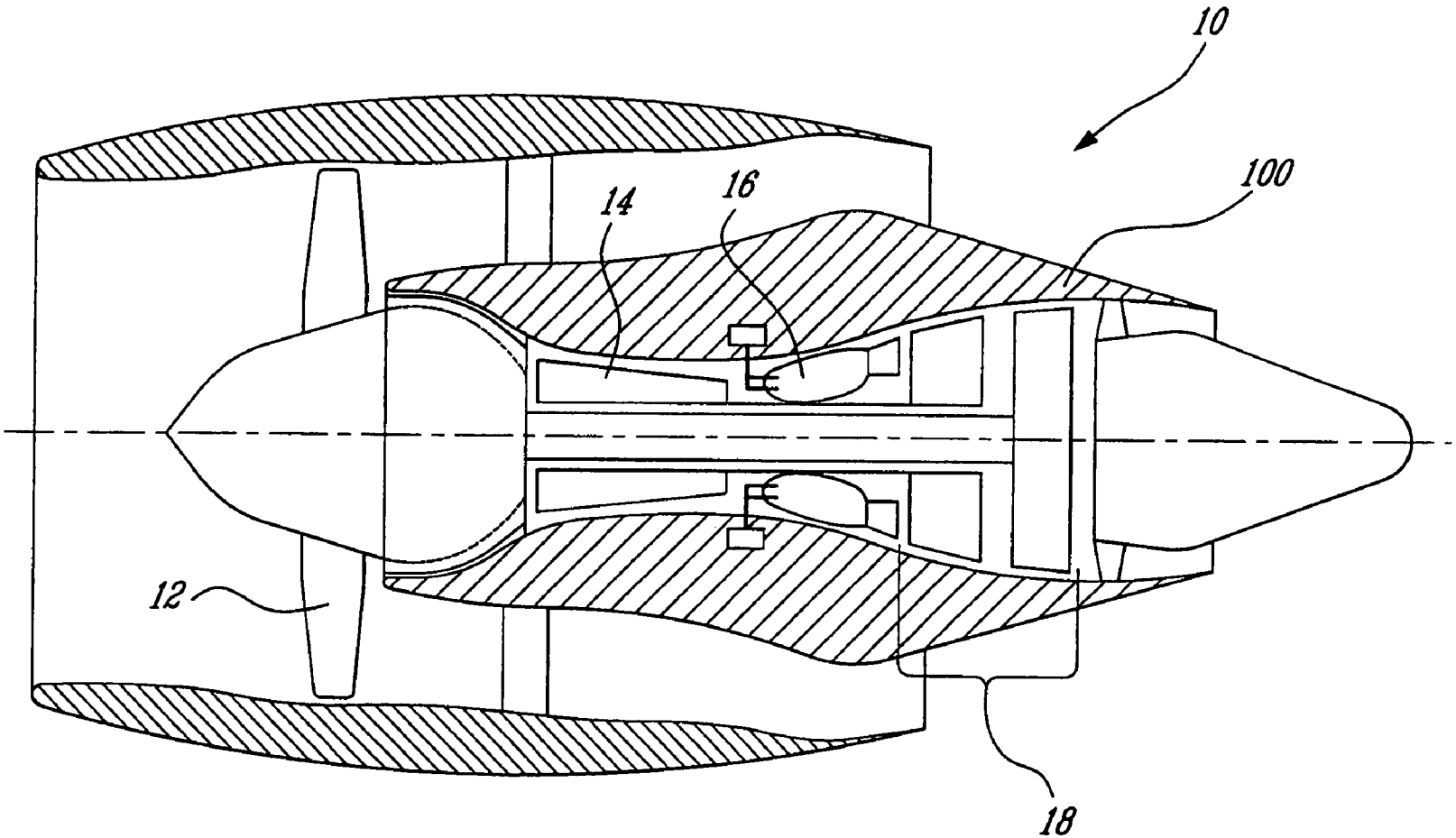
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The turbine section 18 is surrounded by a shroud 100 which is cooled by a flow of secondary air through the shroud.

The embodiments of the present invention can be applied to any turbine, however high pressure ratio stages will have the greatest improvement. The embodiments of the present invention are specifically applicable to high-pressure ratio single stage turbines having shroud segments, which use a combination of impingement, transpiration, and film cooling to reduce the temperature of the shroud segment. However, as persons skilled in the art will appreciate, the embodiments of the present invention are not limited to the above applications.

Figure 2A:
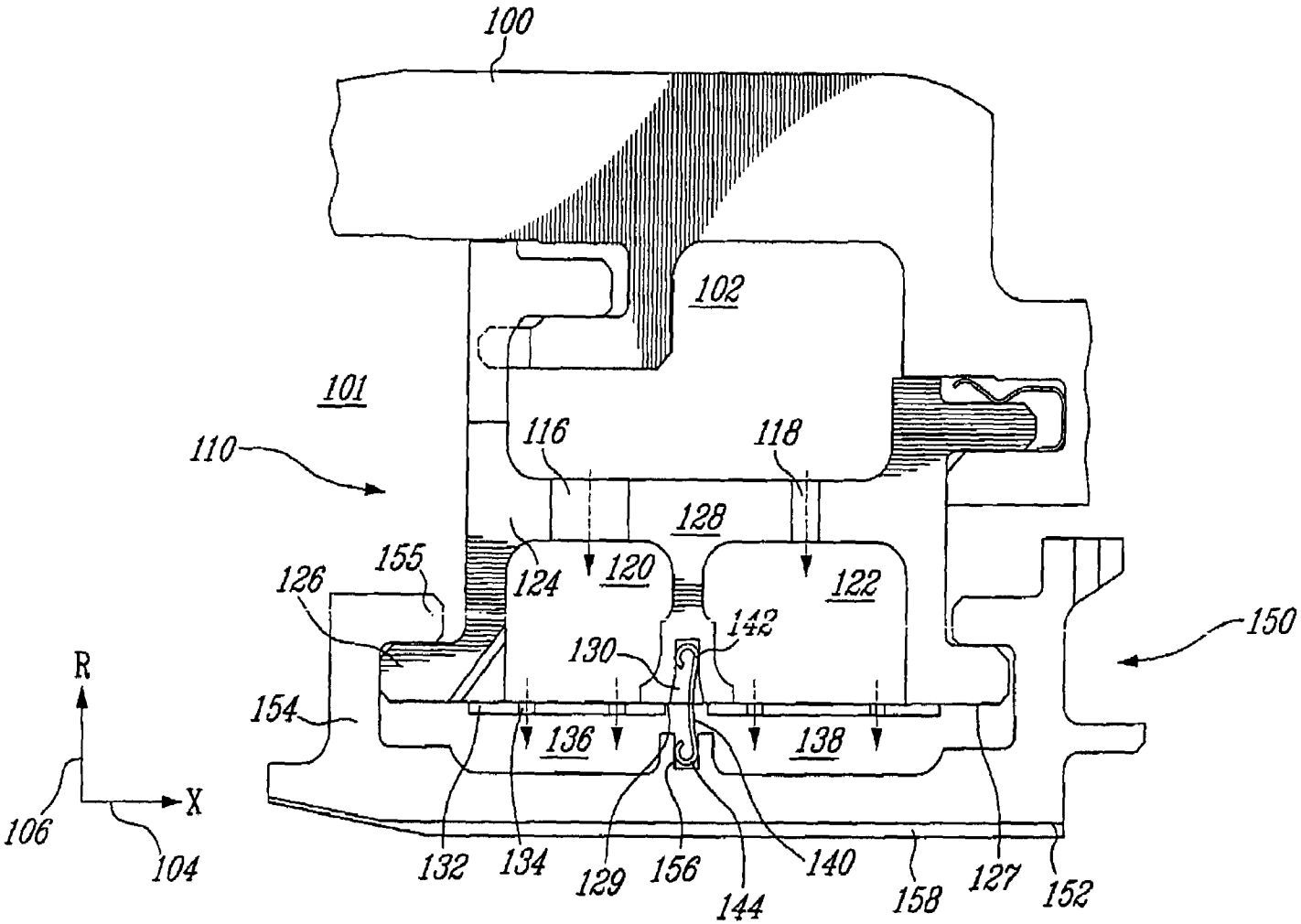
FIGS. 2*a* and 2*b* are an axial cross-section and axial end views, respectively, of a shroud segment arrangement in accordance with an embodiment of the present invention.
Figure 2B:
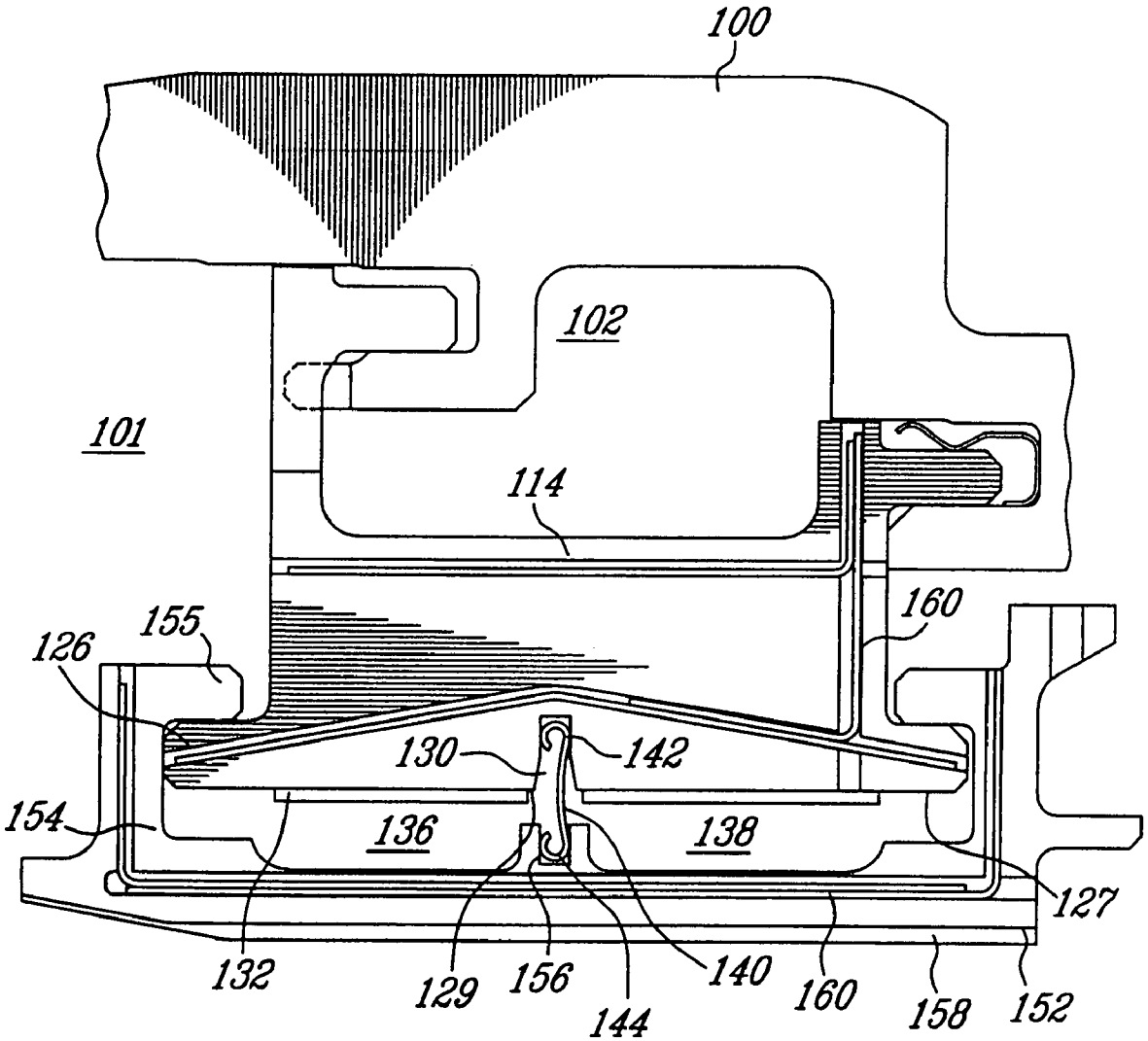

FIG. 2 illustrates an embodiment of the present invention in which a turbine shroud 100 is composed of a shroud ring 150 having an outer portion secured to an inner portion of an annular shroud support assembly 110. In other words, the shroud ring 150 and the shroud support assembly 110 are concentric with the latter surrounding the former.

The shroud support assembly 110 includes a plurality of circumferentially arranged shroud supports 112. Likewise, the shroud ring 150 is composed of a plurality of circumferentially arranged shroud segments 152.

As illustrated by FIG. 2, each shroud support 112 includes a radially outward portion 114 having an upstream aperture 116 and a downstream aperture 118. The upstream aperture 116 is larger in diameter than the downstream aperture 118, although this is not necessarily so. A volume of cooling air, or "secondary air", flows axially downstream from a single supply source 101 into an outer plenum 102. The cooling air bifurcates as it flows through the upstream and downstream apertures 116 and 118 into a first upstream plenum 120 and a first downstream plenum 122.

As depicted in FIG. 2, side walls 124 extend radially inwardly from the upper portion of the shroud support 112 and have an interlocking shoulder 126 for connecting to a respective shroud segment 152. Additionally, a central wall 128 extends radially inwardly from the upper portion of the shroud support 112. The central wall 128 contains a radially inward groove 130 which forms part of a slot for housing a splitting seal 140. The radially inward groove 130 houses an upper portion 142 of the splitting seal 140. As illustrated, the upper portion of the seal 140 has a rounded, hooked end.

Still referring to FIG. 2, an impingement plate 132, or "impingement baffle", is welded or otherwise permanently affixed to a radially inward surface 127 of one of the side walls, to a radially inward surface 129 of the central wall 128 and to the end walls. The impingement plate 132 has a plurality of perforations 134 to permit cooling air to flow from the first upstream plenum 120 into a second upstream plenum 136 and to flow from the first downstream plenum 122 into a second downstream plenum 138.

The shroud segment 152 has a side wall 154 with an interlocking shoulder 155 which engages the shoulder 126 of the shroud support 112 to secure the shroud segment 152 to the shroud support 112. The shroud segment 152 also has a radially outward groove 156 which houses a lower portion 144 of the seal 140. The grooves 130, 156 together constitute a partially enclosed slot for accommodating the splitting seal 140. The splitting seal 140 axially splits adjacent plenums 136 and 138. As depicted in FIG. 2, the second upstream plenum 136 is sealed off from the second downstream plenum 138, thereby permitting a pressure differential to subsist between the second upstream plenum 136 and the second downstream plenum 138. An axial direction 104 (denoted by axis X) and a radial direction 106 (denoted by axis R) are shown for the sake of clarity. A tangential direction is defined normal to both the axial and radial directions.

Further illustrated in FIG. 2 is a plurality of feather seals 160 which are arranged radially and axially, as shown, around the periphery or the shroud segment to minimize leakage around the segments and into the gas path. In this embodiment, a chevron feather seal spans from one shoulder of the shroud support to the other shoulder with its apex above the seal 140. Another feather seal is arranged along a gas-path-exposed surface 158. The skilled reader will appreciate that the chevron shape avoids interference between the feather seal and the splitting seal. As discussed in more detail below, other feather seal configurations are possible and the use of a particular configuration is to be determined by designer preference.

FIG. 2 also shows a working pressure distribution throughout the shroud. Pressures, which are expressed as a percentage of P3 (compressor discharge pressure), are shown in squares to distinguish these numbers from the part reference numerals.

In operation, the shroud is fed axially with cooling air at approximately half of P3, or about 54% as shown in the outer plenum 102. The cooling air flows into the outer plenum 102 from the single supply source 101. From the outer plenum 102, the cooling air then passes through the upstream and downstream apertures 116, 118 in the support shroud 112. Due to the large upstream aperture 116 and the smaller downstream aperture 118, there is only a pressure drop across the downstream aperture 118. Cooling air enters the first upstream plenum 120 at about 54% P3 while it enters the first downstream plenum 122 at about 43% P3. After flowing through the perforated impingement plate 132, the pressure in the second upstream plenum drops to about 51% P3 while the pressure in the second downstream plenum drops to about 40% P3. A further pressure drop is experienced through the film cooling holes in the shroud segment 152 (and the feather seals around segment 152) since the pressure in the upstream portion of the gas path is about 48% P3 whereas the pressure in the downstream portion of the gas path is about 18% P3. The cooling air ejected into the gas path picks up heat and creates a protective film of cooling air along the gas-path-exposed surface of the shroud segment. Since downstream of the turbine blades the static pressure in the gas path is lower than the static pressure upstream of the blades, the shroud segment cavity pressure that is required to eject film cooling flow through the downstream side of the shroud segment 152 is also lower. Since the minimum hole size for film cooling is often a manufacturing constraint, any amount of pressure higher than this minimum requirement will result in higher than required cooling consumption. The pressure values quoted here are of course merely exemplary, as the skilled reader appreciates that pressure can be regulated according to the present invention to suit design needs and efficiency requirements.

The presence of the splitting seal 140 permits a pressure differential to subsist between the second upstream plenum 136 and the second downstream plenum 138. Due to the presence of the splitting seal 140, a pressure differential between adjacent plenums 136 and 138 may subsist, which thermodynamically optimizes the pressure drop across each row of film cooling holes. Furthermore, a downstream portion of the feather seals that are adjacent the gas path experience a lower pressure drop, which further reduces cooling flow consumption.

By virtue of the splitting seal 140, and the attendant optimization of pressure drop, the shroud is thermodynamically more efficient and thus requires less secondary air flow to cool the shroud. Accordingly, overall engine performance is thus improved without sacrificing shroud durability.

Figure 3:
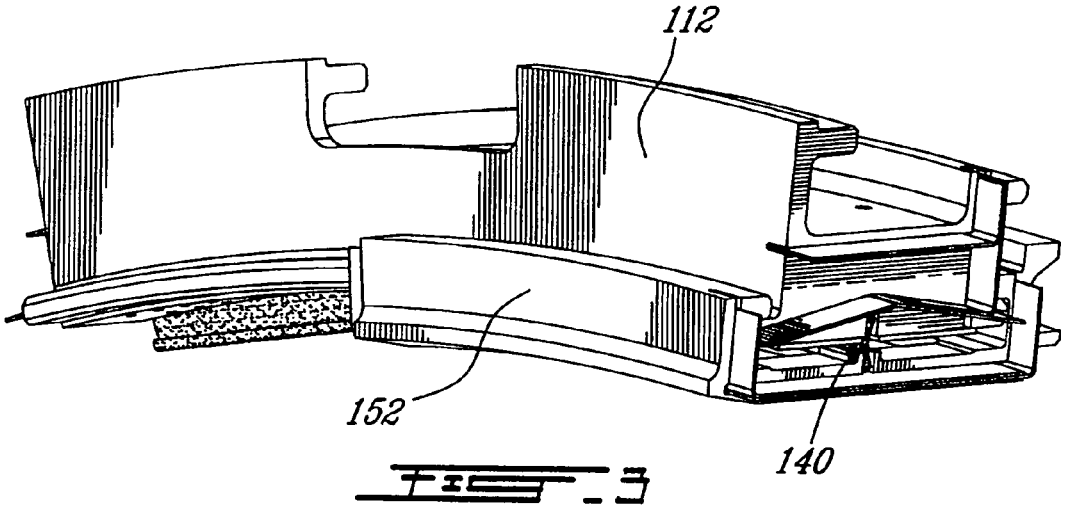
FIG. 3 is a perspective view of a shroud segment affixed to a shroud support in accordance with an embodiment of the present invention.

As illustrated in FIG. 3, two shroud segments 152 are typically supported by a single shroud support 112. The splitting seal 140 is housed within a partially enclosed slot and extends along the interface of the shroud support 112 and shroud segment 152.

Figure 4:
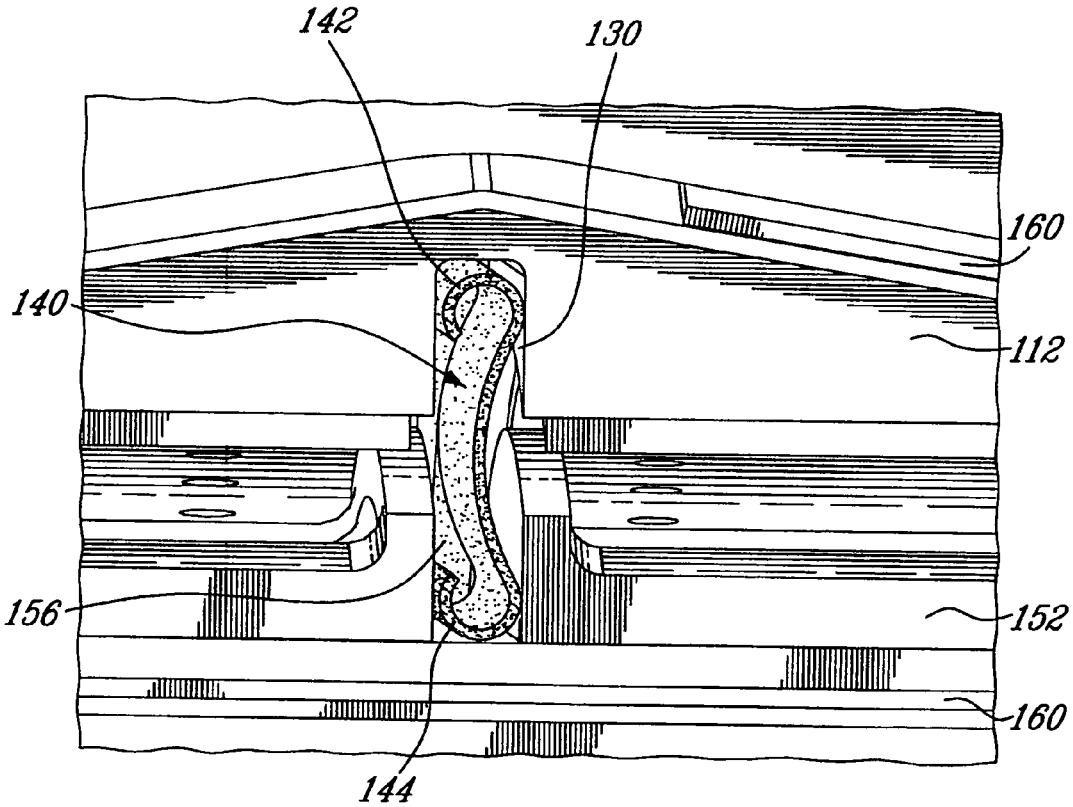
FIG. 4 is a perspective view of a splitting seal housed in a straight slot at an interface of a shroud support and a shroud segment in accordance with an embodiment of the present invention.

As shown in FIG. 4, the splitting seal 140 is housed in a straight slot composed of the radially inward groove 130 in the shroud support 112 and the radially outward groove 156 in the shroud segment 152. The slot is partially enclosed and generally rectangular in shape with a radial height greater than an axial depth.

As illustrated in FIG. 4, the splitting seal 140 has a central portion which is curved, or "arcuate". The splitting seal 140 also has an upper portion (i.e. a radially outward portion) which is rounded and hooked as well as a lower portion (i.e. a radially inward portion) which is also rounded and hooked. This is also referred to as a "dog-bone" shape. Other shapes of seals, such as crescent seals (i.e., with no hooked or otherwise rounded ends), may be used, according to the designer's preference. As depicted in FIG. 4, the splitting seal 140 fits radially outward of the feather seals 160 adjacent the gas path and radially inward of the chevron-shaped feather seals. The shroud is assembled by first sliding a shroud segment 152 onto its respective shroud support 112. For ease of assembly, there is one splitting seal 140 per shroud segment 152. This straight segmented seal 140 is slid into place its tangential slot which is recessed both into the shroud segment 152 and the shroud support 112 in the manner described above. Sliding a second shroud segment onto the shroud support and installing the feather seals and a splitting seal(s) completes a shroud subassembly. Once enough shroud subassemblies are made to form a ring, the shroud subassemblies are held with chucks and the shroud is fitted around the turbine section as a unit.

Figure 5:
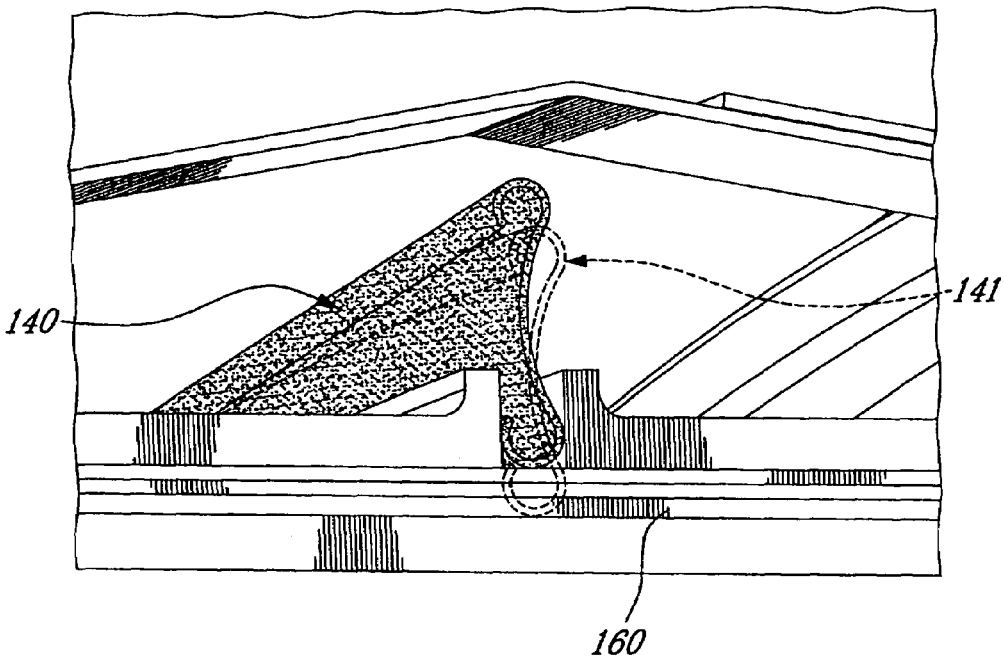
FIG. 5 is a perspective view of a straight seal and a circumferential seal in accordance with embodiments of the present invention.

FIG. 5 illustrates both a straight seal 140 and a circumferential seal 141 merely for description purposes; the inventor does not necessarily contemplate the use of such seals together. While either one may be used, the straight seal 140 is preferred because it helps to minimize the thickness of the shroud segment's end walls because, as depicted in FIG. 5, employing the circumferential seal 141 requires that the feather seals 160 be located closer to the gas path to avoid interference between seals, which reduces wall width. Where the circumferential seal 141 is to be used, a circumferential slot may be provided.

Figure 6:
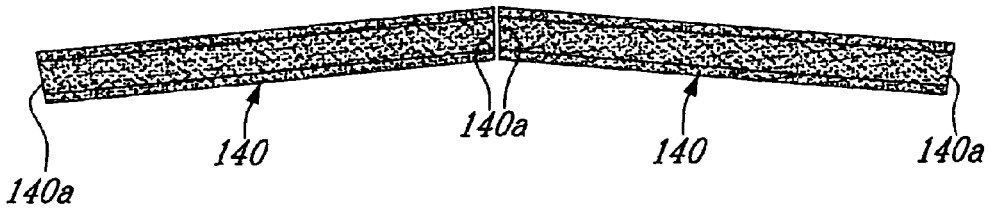
FIG. 6 is a front (axial) view of straight splitting seals cut to fit within the annular slot in accordance with an embodiment of the present invention.

As shown in FIG. 6, the ends 140*a* of the straight splitting seals 140 are cut at an angle to provide the minimum gap between adjacent seals. If the gap is too large, air leakage will occur and the pressure differential between adjacent plenums (i.e. between upstream and downstream plenums) will be lost or degraded.

Figure 7:
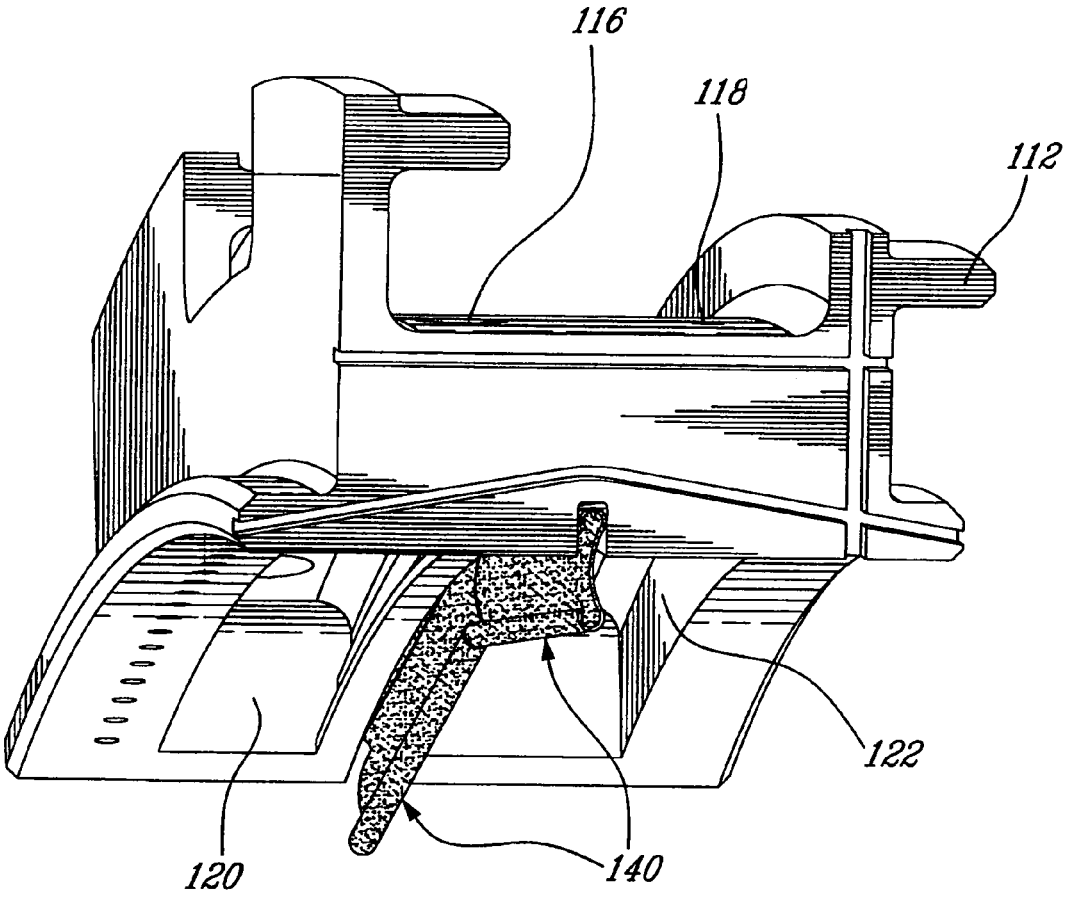
FIG. 7 is a perspective view of a shroud support with splitting seals housed within a radially inward groove in the shroud support.

As partly illustrated in FIG. 7, a plurality of angle-cut (or beveled) splitting seals 140 are arranged circumferentially to form an annulus at the interface between a shroud segment (not shown in FIG. 7) and its respective shroud support 112. (Though the term "interface" is used in this application, this is does not necessarily mean contact exists or must exist between adjacent parts.). FIG. 7 also shows the curved shape of the first plenums 120, 122 which communicate with apertures 116, 118 to define upstream and downstream passageways for the cooling air.

Figure 8A:
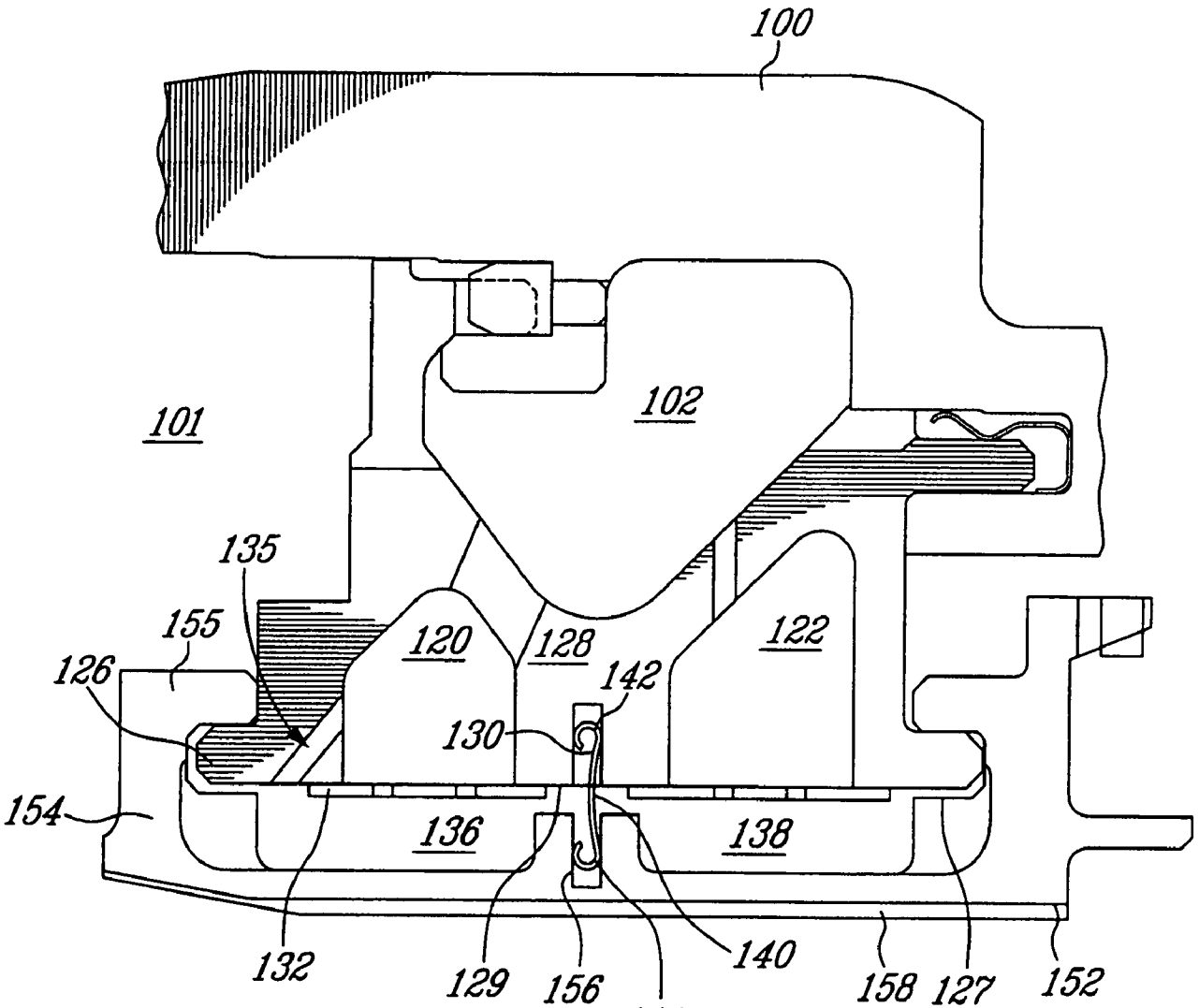
FIGS. 8*a* and 8*b* are an axial cross-section and axial end views, similar to 2*a* and 2*b*, of another embodiment of the present invention.
Figure 8B:
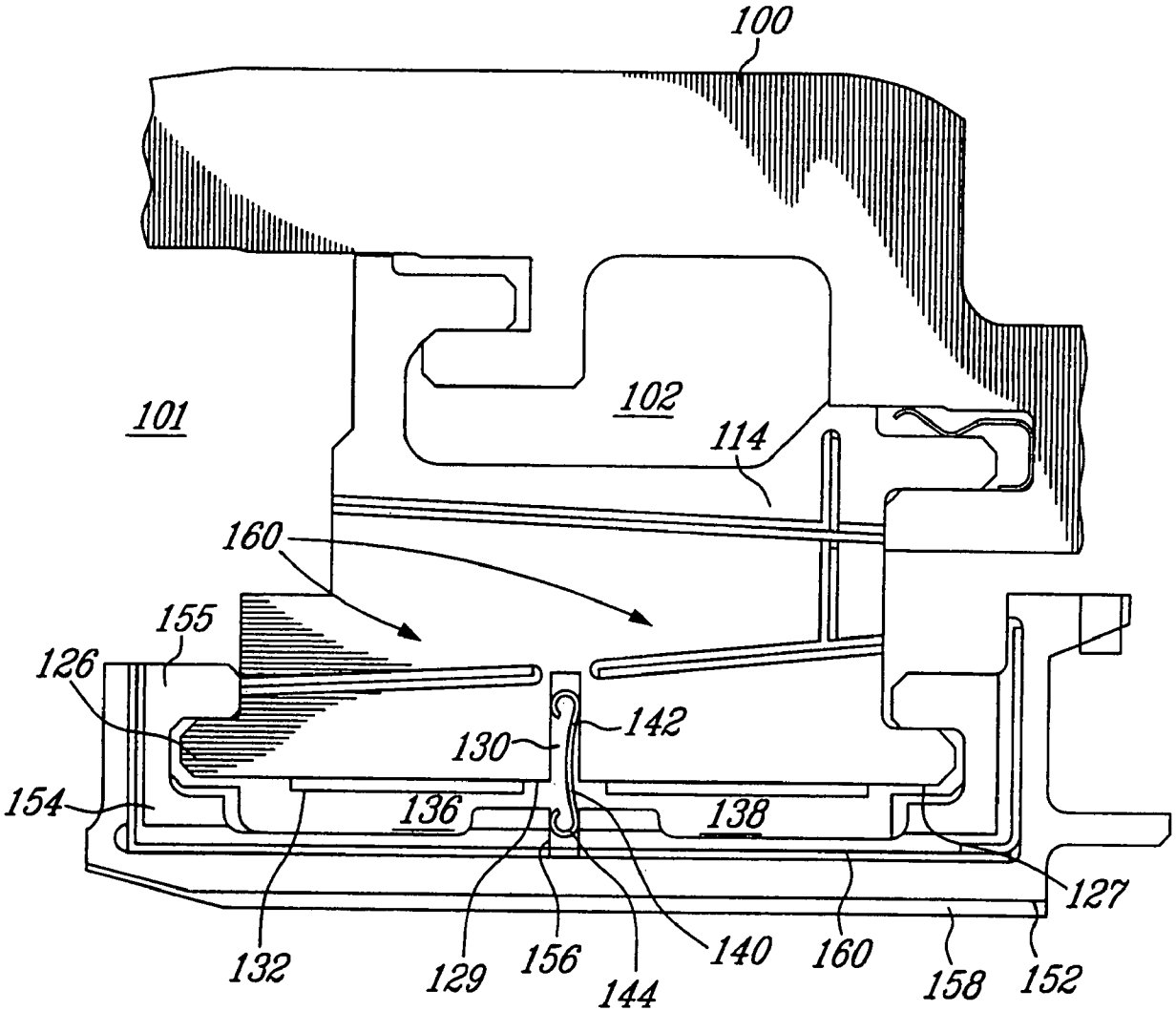

Referring to FIGS. 8*a* and 8*b*, another embodiment is shown. Like reference numerals indicated like features, and the embodiment is generally constructed and operates as depicted in these Figures and described above, and thus the embodiment need only briefly be addressed here. The shroud support configuration may be modified as required to provide an appropriate configuration to suit envelope, weight, stress and cooling considerations. The impingement places may have differing cooling hole effective areas (i.e. density and or size variations) to further permit regulation of cooling air pressure in the paths. A shown in FIG. 8*a*, the impingement cooling holes 134 in the upstream and downstream plates 132 are different. Air provided to the plenums may also be redirected through passage 135 for additional cooling, such as shroud leading edge cooling as shown in FIG. 8*a*. Referring to FIG. 8*b*, the feather seals 160 around the segment are subject to design choice, and in this embodiment the chevron seal is replaced with a pair of straight feather seals. This separation of the end face feather seal into two permits a positive pressure differential to exist at one end of the shroud, and a negative differential at the other end, and still maintain good sealing (a positive differential across one leg of the chevron and a negative differential across the other leg would compromise the sealing effectiveness of the feather seal.

Although the splitting seal 140 is shown to have a specific shape and location, it should be appreciated that the precise shape and location of the seal may be varied depending on the design of the engine. Furthermore, although only a single seal is used per shroud segment, it is possible to axially split the cooling air into more than two plenums. Two (or more) splitting seals may be used to split the cooling air into, for instance, an upstream plenum, a middle plenum and a downstream plenum.

The embodiments of the invention described above are intended to be exemplary. Those skilled in the art will therefore appreciate that the forgoing description is illustrative only, and that various alternatives and modifications can be devised without departing from the spirit of the present invention. For example, any number of cooling paths may be provided (not just two). Also, any suitable seal arrangement or configuration can be used to split the shroud internal cavity in any desired number of sealed portions. Furthermore, it is understood that any suitable shroud support configuration can be used with the present invention. The functions of the shroud support and shroud segment may be integrated into one component without departing from the spirit of the present invention. The person skilled in the art will also appreciate that any number of pressure modifications may be provided in a cooling path. The paths may be arranged in any suitable arrangements relative to one another, and need not be in parallel, side-by-side nor upstream and downstream of one another. Though a common cooling supply is preferred, the present seal arrangement may be used with air supplied from different sources. The shroud may be segmented or a continuous ring. Still other modification is possible without departing of the scope of the invention disclose. Accordingly, the present is intended to embrace all such alternatives, modifications and variances which fall within the scope of the appended claims.

What is claimed is:

1. A gas turbine shroud assembly comprising a shroud body defining a first cooling path and a second cooling path, the first and second cooling paths communicating with a common cooling air supply, the first cooling path adapted to deliver cooling air to a first shroud surface and the second cooling path adapted to deliver cooling air to a second shroud surface, wherein the first and second paths are configured such that, in use, cooling air is delivered to said first and second shroud surfaces by said first and second cooling paths at different pressures relative to one another, wherein at least one of the cooling paths includes at least two stages of discontinuous pressure drop, said at least two stages of discontinuous pressure drop being exclusive to said at least one of the cooling paths.

2. A shroud assembly as defined in claim 1, wherein the shroud body comprises a shroud support and a shroud member, and wherein the shroud support is adapted to be mounted to a gas turbine engine casing and the shroud member is mounted to the shroud support.

3. A shroud assembly as defined in claim 2, wherein the shroud support is adapted to provide a plurality of cooling fluid supplies at different pressures to a plurality of shroud surfaces.

4. A shroud assembly as defined in claim 2, wherein said first and second cooling paths extend through the shroud support.

5. A shroud assembly as defined in claim 4, wherein a downstream portion of said first and second cooling paths are separated from one another by a seal extending between said shroud support and said shroud member.

6. A shroud assembly as defined in claim 1, wherein said first and second cooling paths are at least partially separated by a flexible seal.

7. A shroud assembly as defined in claim 6, wherein the seal permits relative movement between the shroud support and the shroud member.

8. A shroud assembly as defined in claim 6, wherein the seal extends between the shroud support and the shroud member.

9. A shroud assembly as defined in claim 8, wherein a first end portion of the seal is housed within a first radial groove in the shroud support and a second end portion of the seal is housed within a second radial groove in the shroud member.

10. A shroud assembly as defined in claim 6, wherein the seal is provided in linear segments.

11. A shroud assembly as defined in claim 10, wherein the linear segments have angled ends, the angled ends adapted to minimize leakage between adjacent segments.

12. A turbine shroud assembly comprising a shroud support supporting a shroud ring, a cooling plenum defined between said shroud ring and said shroud support, and a seal extending from said shroud ring to said shroud support, the seal splitting a first portion of the cooling plenum from a second portion thereof and thereby permitting a pressure differential to be maintained between the first portion and the second portion, wherein said seal includes a plurality of circumferentially arranged seal segments, wherein each of the seals has opposed ends, and wherein the ends of the seal segments are cut on an angle to provide a minimal inter-segment gap between each pair of adjacent seal segments.

13. A turbine shroud assembly as defined in claim 12, wherein the seal is adapted to permit relative thermal expansion between the shroud ring and the shroud support.

14. A turbine shroud assembly as defined in claim 12, wherein the first and second portions communicate with a common cooling supply.

15. A turbine shroud assembly as defined in claim 14, wherein said shroud support defines a radially inward groove, wherein said shroud ring defines a radially outward groove, the radially outward and the radially inward grooves being aligned to form an at least partially enclosed cavity, and wherein said seal is engaged within said cavity.

16. A turbine shroud assembly as defined in claim 12, wherein the seal is flexible.

17. A turbine shroud assembly as defined in claim 12, wherein the seal is slidably received in a slot defined in the shroud support and the shroud ring.

18. A turbine shroud assembly as defined in claim 12, wherein the seal is dogbone-shaped.

19. A gas turbine engine comprising: a compressor section, a combustion section and a turbine section serially connected to one another, a shroud ring concentrically mounted within a shroud support for surrounding a stage of turbine blades, and a radially extending seal between the shroud support and the shroud ring, the seal separating an upstream plenum from adjacent downstream plenum and maintaining a pressure differential therebetween, the upstream plenum and the downstream plenum forming part of two separate flow paths including means for independently modifying the pressure of cooling fluid proving to said upstream and downstream plenums, wherein said means provides at least two discontinuous pressure drops in one of said flow paths, said at least two discontinuous pressure drops being exclusive to said one flow path.

20. A gas turbine engine as defined in claim 19, wherein at least one perforated impingement plate is mounted to a radially inner surface of the shroud support for delivering cooling air to said upstream and downstream plenums.

21. A gas turbine engine as defined in claim 19, wherein said shroud support defines an upstream cooling path and a downstream cooling path respectively leading to said upstream plenum and said downstream plenum.

22. A gas turbine engine as defined in claim 19, wherein the shroud support is adapted to provide a plurality of cooling air supplies at different pressures to the upstream and the downstream plenums.

23. A gas turbine engine as defined in claim 22, wherein cooling fluid is received by the shroud support from a single supply source.

24. A gas turbine engine as defined in claim 19, wherein a first end portion of the seal is housed within a first radial groove in the shroud support and a second end portion of the seal is housed within a second radial groove in the shroud ring.

25. A seal for a gas turbine engine comprising a shroud support and a shroud member, the shroud support and shroud member co-operating to define a plurality of shroud impingement cooling paths therethrough, the shroud support including at least one circumferential groove through a central portion thereof between at least a first impingement cooling path and a second impingement cooling path, the shroud member including at least one circumferential groove through a central portion thereof between at least a first impingement cooling path and a second impingement cooling path, the seal comprising a first curved end adapted for sealing insertion into the shroud support circumferential groove, and a second curved end adapted for sealing insertion into the shroud member circumferential groove, the seal thereby adapted to maintain a pressure differential between said first and second impingement cooling paths, wherein the seal comprises a plurality of substantially linear segments, and wherein the seal segments include angled mating ends.

* * * * *